US007343882B2

(12) United States Patent
Pipkorn et al.

(10) Patent No.: US 7,343,882 B2
(45) Date of Patent: Mar. 18, 2008

(54) FLUID VALVE

(75) Inventors: Nicholas T. Pipkorn, Gladstone, MI (US); David J. Allen, Gladstone, MI (US); Mark S. Bader, Gladstone, MI (US); Stephen J. Shiverski, Perronville, MI (US)

(73) Assignee: EMP Advanced Development, Inc., Escanaba, MI (US)

( * ) Notice: Subject to any disclaimer, the term of this patent is extended or adjusted under 35 U.S.C. 154(b) by 17 days.

(21) Appl. No.: 11/400,811

(22) Filed: Apr. 7, 2006

(65) Prior Publication Data

US 2007/0234979 A1 Oct. 11, 2007

(51) Int. Cl.
*F01P 7/14* (2006.01)

(52) U.S. Cl. ..... 123/41.1; 123/41.08

(58) Field of Classification Search ..... 123/41.1, 123/41.08, 41.09, 41.02; 236/34.5
See application file for complete search history.

(56) References Cited

U.S. PATENT DOCUMENTS 3,124,162 A 3/1964 Cameron
5,529,026 A 6/1996 Kurr et al.
5,950,576 A 9/1999 Busato et al.
6,164,248 A * 12/2000 Lehmann ..... 123/41.1
6,371,060 B1 4/2002 Lehmann et al.
6,539,899 B1 4/2003 Piccirilli et al.
6,688,333 B2 2/2004 McLane et al.
2002/0179165 A1 12/2002 Hu et al.
2003/0217775 A1 11/2003 Cousineau et al.
2005/0034688 A1 2/2005 Lelkes et al.

* cited by examiner

*Primary Examiner*—Stephen K. Cronin
*Assistant Examiner*—Hyder Ali
(74) *Attorney, Agent, or Firm*—Brooks Kushman P.C.

(57) ABSTRACT

A fluid valve for use in proportioning/mixing fluid between at least one input and at least one output. The fluid valve including a rotary actuated diverter for controlling fluid flow between the inlet(s) and outlet(s). The fluid valve may be configured to support proportioning any number of fluids, including liquids and gases, for any number of applications, including automotive and industrial applications.

41 Claims, 4 Drawing Sheets

FLUID VALVE

BACKGROUND OF THE INVENTION

1. Field of the Invention

The present invention relates to fluid valves.

2. Background Art

Fluid valves proportion fluid between one or more inlets and one or more outlets. Fluid valves may include a diverter or other feature within a housing defining a fluid flow path between the inlet(s) and outlet(s). Fluid valves can be used to proportion any number of fluids, including liquids and gases. Fluid valves are operable in any number of environments, including industrial and automotive environments.

SUMMARY OF THE INVENTION

One non-limiting aspect of the present invention relates to a fluid valve configured to proportion fluid flow entering a housing radially and exiting the housing radially.

One non-limiting aspect of the present invention relates to a fluid valve having a free-floating diverter configured to proportion the radially entering and exiting fluid flow.

One non-limiting aspect of the present invention relates to a cooling system for use with an engine. The system may include a radiator, a radiator bypass, a fluid valve in communication with the engine, radiator, and radiator bypass. The fluid valve may be controllable to proportion coolant from the engine to one or both of the radiator and radiator bypass in order to control engine cooling.

The fluid valve may include a housing having an inlet for receiving coolant from the engine and separate outlets at a common end of the housing for outputting coolant to the radiator and radiator bypass. The inlet and outlets may define radial apertures at opposite ends of the housing such that coolant must enter radially through the inlet and travel axially through the housing for radial output through the outlets.

The fluid valve may further include a rotary actuated diverter within the housing between the inlet and outlets. The diverter may be rotatable about an axis defined relative to the axial travel of the coolant and the radial inlet and outlets. The diverter may be rotatable to selectively cover the outlets and thereby proportion coolant between the inlet and outlets associated with the radiator and radiator bypass.

Alternatively, the fluid valve may include a free-floating rotary actuated diverter within the housing between the inlet and outlets. The diverter may be rotatable to selectively cover the outlets and thereby proportion coolant between the inlet and outlets associated with the radiator and radiator bypass.

The housing may include a gateway extending widthwise across the axis and between the inlet and outlets. The gateway may include an aperture to each of the outlets, wherein the diverter is positioned proximate the gateway and configured to rotate about the gateway apertures to selectively proportion coolant between the outlets. An area of a diameter of the gateway may be greater than a total area of a diameter of the outlets and/or less than twice the total area of the diameter of the outlets. The apertures of the gateway may be of equal size and divided along a center of a diameter of the gateway.

The diverter may be free-floating within the housing and located on an upstream side of the gateway such that pressure of coolant entering the inlet causes the diverter to compress against the gateway.

The system may include an electric motor and shaft. The shaft may be connected to the electric motor and configured to rotate with the rotation thereof. The diverter may be connected to the shaft so as to rotate with the rotation thereof such that rotation of the motor selectively positions the diverter relative to the gateway apertures to control coolant flow to the outlets.

The system may include a fail-safe feature configured to rotate the diverter to open the radiator aperture if power is lost to the electric motor. The fail-safe feature may be configured to locate the diverter downstream of the inlet in the absence of coolant flow through the inlet.

The system may include an alignment feature configured to located the diverter downstream of the inlet in the absence of coolant flow through the inlet.

One non-limiting aspect of the present invention relates to a fluid valve having a housing and diverter. The housing may include an inlet for receiving fluid and an outlet at an opposite end of the housing for outputting the received fluid. The inlet and outlet may define radial apertures at opposite ends of the housing such that coolant must enter radially through the inlet and travel axially through the housing for radial output through the outlet.

The diverter may be rotary actuated and positioned within the housing between the inlet and the outlet. The diverter may be rotatable about an axis defined relative to the axial travel of the coolant and the radial inlet and outlet, the diverter being rotatable to selectively cover the outlet and thereby proportion fluid between the inlet and outlet.

Alternatively, the diverter may be a free-floating rotary actuated diverter and positioned within the housing between the inlet and outlet. The diverter may be rotatable to selectively cover the outlet and thereby proportion coolant between the inlet and outlet.

The fluid valve may include a gateway extending widthwise across the axis and between the inlet and outlets. The gateway may include an aperture to the outlet and a covered aperture. The diverter may be positionable relative to the covered aperture to limit and/or prevent fluid flow through the outlet Alternatively, the fluid valve may include a second outlet at the opposite end of the housing such that both outlets are located at a common end of the housing downstream of the inlet. The housing may include a gateway extending widthwise across the housing and between the inlet and outlets. The gateway may include an aperture to each of the outlets such that the diverter is positioned proximate the gateway and configured to rotate about the gateway apertures to selectively proportion coolant between the outlets.

The above features and advantages, along with other features and advantages of the present invention, are readily apparent from the following detailed description of the invention when taken in connection with the accompanying drawings.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION OF THE PREFERRED EMBODIMENT(S)

Figure 1:
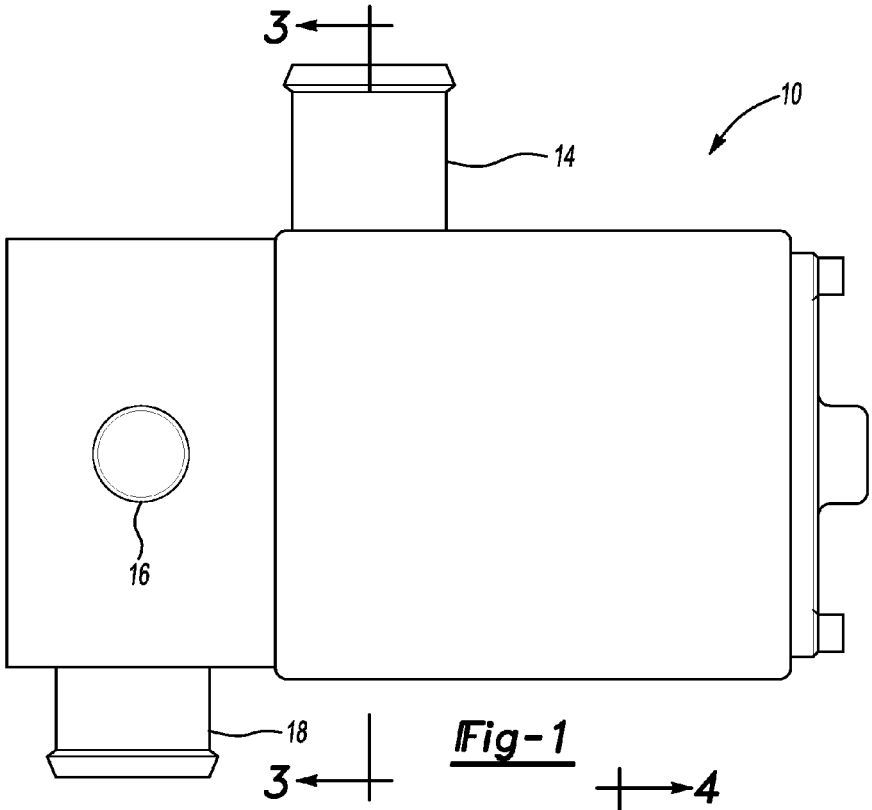
FIGS. 1-2 illustrate a fluid valve in accordance with one non-limiting aspect of the present invention.
Figure 2:
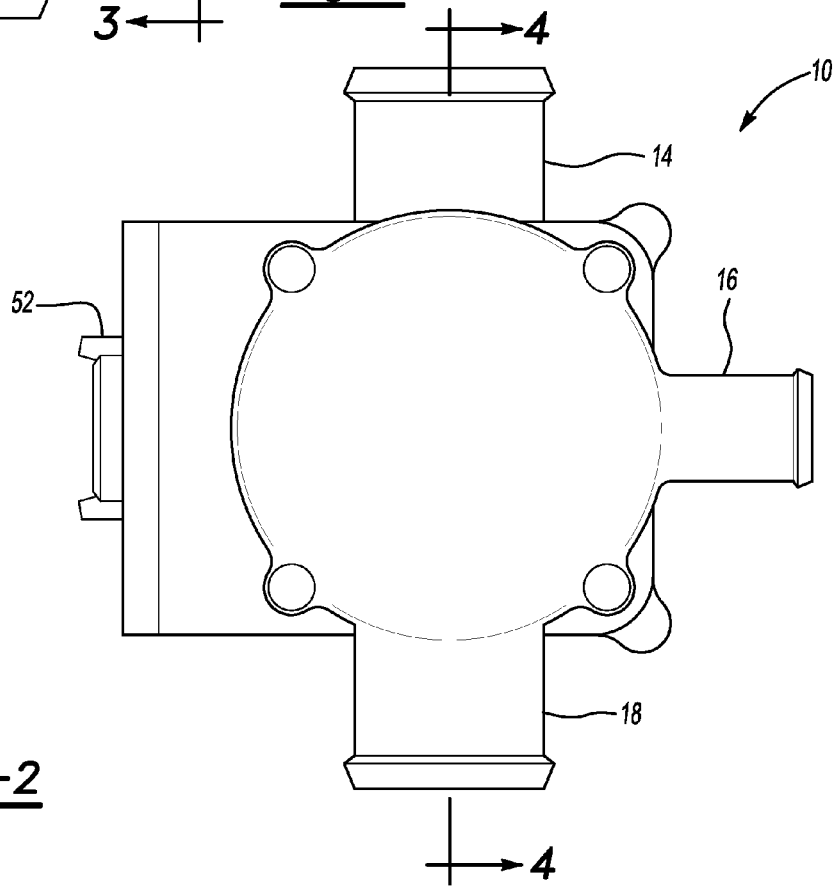

FIGS. 1-2 illustrate a fluid valve 10 in accordance with one non-limiting aspect of the present invention. The fluid valve 10 is configured to proportion or otherwise control fluid flow therethrough. The fluid valve 10 may include any number of inlets and outlets for respectively receiving and outputting fluid. The fluid valve 10 may proportion any number of fluids, including liquids, gases, or some combination thereof.

For exemplary purposes, the fluid valve 10 is shown to include one inlet 14 and two separate outlets 16-18 such that fluid may be proportioned from the inlet 14 to either outlet 16-18. Optionally, as described below in more detail, the inlet(s) 14 is located upstream from a diverter 22 and the outlet(s) 16-18 are located downstream from a diverter (see FIG. 3*a*-3*c*) at a common end such that the diverter 22 is free to float in the direction of fluid flow through the fluid valve 10.

Figure 3A:
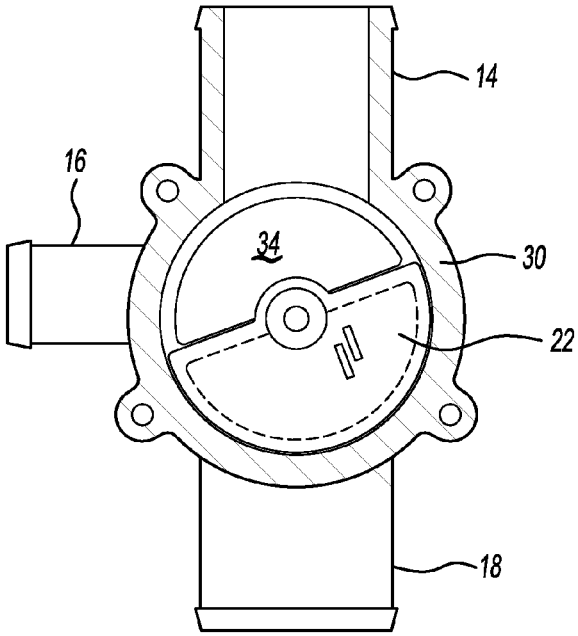
FIGS. 3*a*-3*c* illustrate a cross-sectional view of the fluid valve taken along line 3-3 in accordance with one non-limiting aspect of the present invention.
Figure 3B:
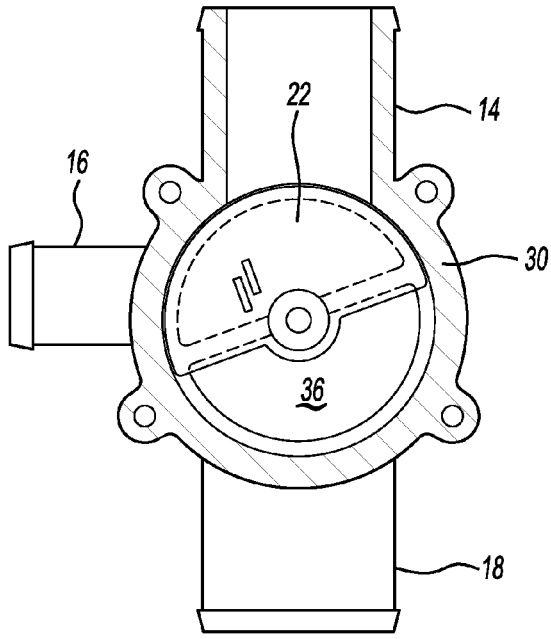
Figure 3C:
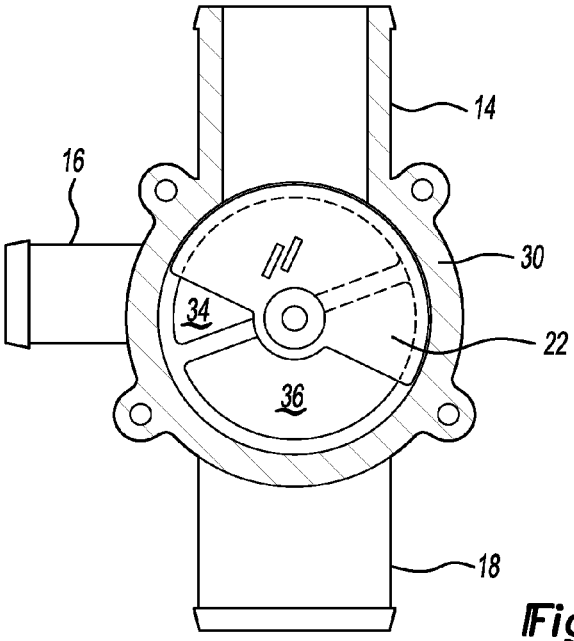

FIGS. 3*a*-3*c* illustrate a cross-sectional view of the fluid valve 10 taken along line 3-3 in accordance with one non-limiting aspect of the present invention. The cross-sectional view illustrates multiple proportioning positions of the diverter 22 in accordance with one non-limiting aspect of the present invention. The diverter 22 may be disc shaped and configured in the shape of a half circle.

Figure 4:
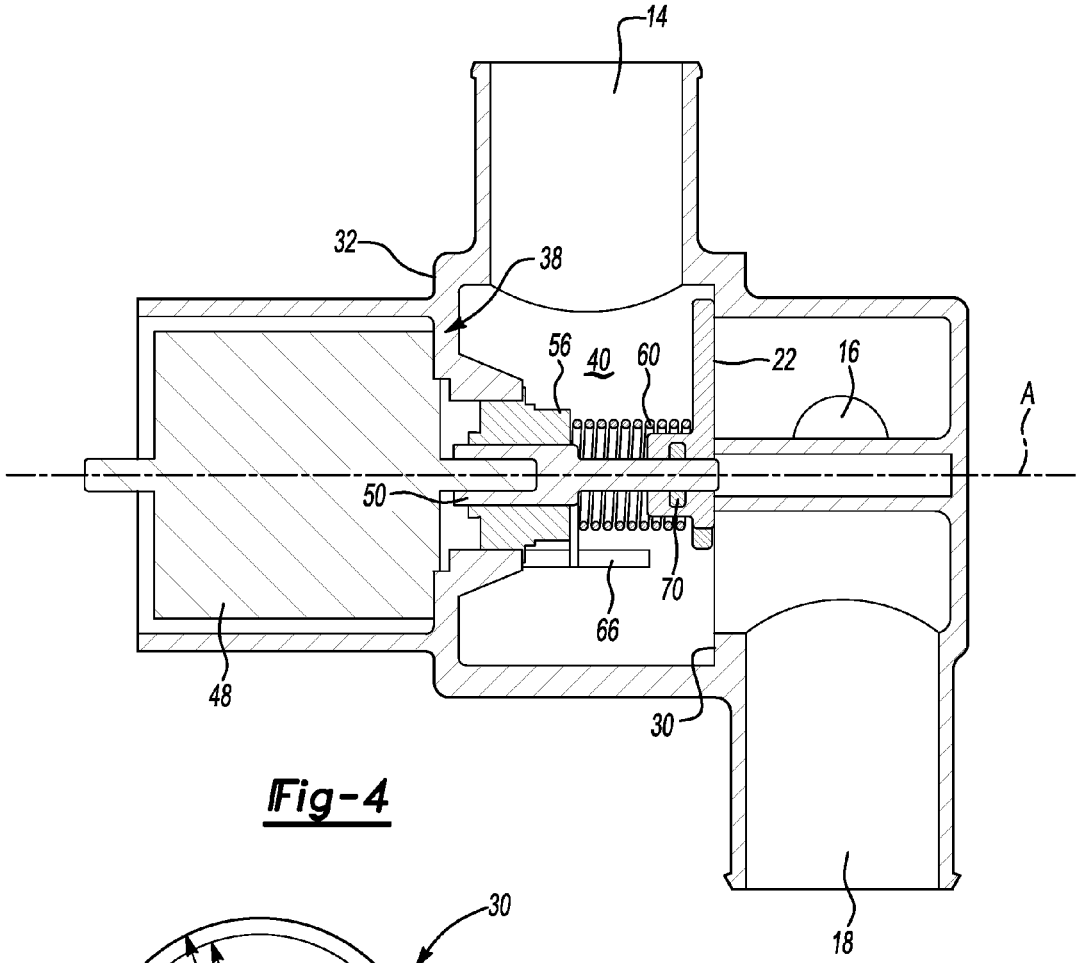
FIG. 4 illustrates a cross-sectional view of the fluid valve taken along line 4-4 in accordance with one non-limiting aspect of the present invention.

As shown in more detail with FIG. 4, the diverter 22 is positioned proximate a gateway 30. The gateway 30 is generally defined as a planar portion of a housing 32 or element in the housing 32 that extends widthwise across the housing 32 and includes apertures 34-36 for carrying fluid to each of the outlets 16-18. The diverter 22, as shown in FIGS. 3*a*-3*c*, may be positioned relative to the gateway apertures 34-36 to control fluid flow to the corresponding outlets 16-18.

FIGS. 3*a*-3*c* respectively illustrate completely opening the first outlet 16 and covering the second outlet 18, completely opening the second outlet 18 and covering the first outlet 16, and partially opening the first 16 and second outlets 18. The present invention contemplates the diverter 22 having any number of configurations and shapes to simultaneously proportion fluid flow to one or more of the outlets 16-18 or additional outlets (not shown). As shown, the apertures 34-36 are equal sized and divide about the center of the gateway 30 so as to facilitate the sealing thereof with the half-circle shape of the diverter 22.

Optionally, in an alternative embodiment and/or if use of one of the outlets 16-18 is unnecessary, one of the apertures 34-36 may be covered with the material of the gateway 30 such that the gateway 30 only includes one aperture for the single outlet or active outlet. In this manner, the diverter 22 can be positioned relative to the covered gateway aperture to facilitate proportioning fluid to the single outlet.

FIG. 4 illustrates a cross-sectional view of the fluid valve 10 taken along line 4-4 in accordance with one non-limiting aspect of the present invention. As shown, the fluid valve 10 may include the axially elongated housing 32 having an annular proportioning portion 38 upstream of the gateway 30. The proportioning portion 38 includes a cavity 40 for defining a fluid flow path from the inlet 14 to the outlets 16-18.

The diverter 22 is positioned downstream from the inlet 14 and upstream of the gateway 30 within the fluid flow path. The fluid enters radially through the inlet 14 and then flows axially through the gateway 30 to exit radially through the outlets 16-18. The positioning of the gateway 30 and diverter 22 along an axis A defined relative to the axial travel of fluid and the radial inlets 14 and outlets 16-18 can be used to allow the diverter 22 to float with fluid pressure from the inlet toward the gateway 30.

An electric motor 48 may be included to control rotation of the diverter 22. A shaft 50 or other feature may be connected to the motor 48 and the diverter 22 may be mounted thereto such that rotation of the motor 48 causes rotation of the diverter 22. The motor 48 may be a rotary type motor controlled by signals received from a controller (not shown). The controller may include an adapter 52 or other feature for receiving signals from a control module or other feature (not shown) configured to control/instruct the operation thereof.

A mechanical seal 56 or other sealing feature may be included to seal the shaft 50 and motor 48 from fluid entering from proportioning portion 38. A fail-safe 60 feature may be included to bias the diverter 22 to a selected position should the ability of the motor 48 to position the shaft 50 be lost, such as through loss of torque associated with motor power or other operational interrupt. The fail-safe feature 60, as shown, may be a spring connected between fingers 64-66 on the housing and diverter 22.

Optionally, the diverter 22 is freely mounted to the shaft 50 such that it may float axially along the shaft 50. This may be advantageous in assembling the fluid valve as it permits better tolerances and ease of assembly. The fail-safe feature 60 may apply pressure against the diverter to position it downstream of the inlet 14 and against the gateway 30. Once so positioned, fluid flow through the inlet 14 then further compresses the diverter 22 against the gateway 30.

An alignment feature 70 may be included to position the diverter 22 downstream of the inlet 14 along the shaft 50. The alignment feature 70 may be a pin or other feature extending through the shaft 50. This feature can be used to insure proper positioning of the diverter 22 downstream from the inlet if the fail-safe feature 60 is omitted and/or if the fail-safe feature 60 is otherwise unable to properly position the diverter.

Figure 5A:
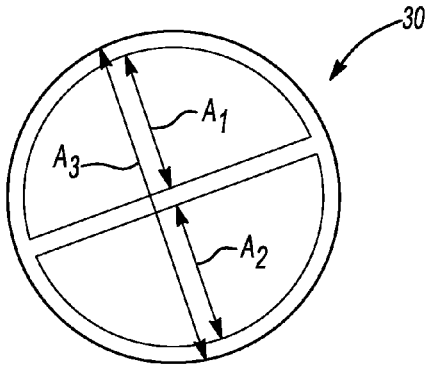
FIGS. 5*a*-5*c* illustrate end views of a gateway and outlets in accordance with one non-limiting aspect of the present invention.
Figure 5B:
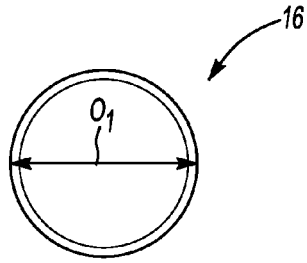
Figure 5C:
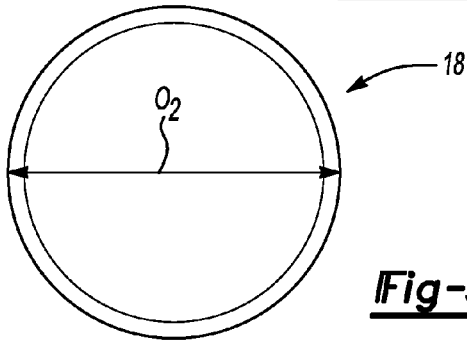

FIGS. 5*a*-5*c* illustrate end views of the gateway 30 and outlets 16-18 in accordance with one non-limiting aspect of the present invention. The leader lines labeled A1, A2, A3, O1, and O2 are included to reference dimensions used by the present invention to determine areas for the apertures associated therewith. Areas A1 and A2 correspond with the gateway apertures 34-36, area A3 corresponds with the area of an outer diameter of the gateway 30, and areas O1 and O2 correspond with the area of the outside of the outlets 16-18 by which a hose or other connecting feature (not shown) may be attached for connection to the fluid valve.

The radial mounting of the inlet 14 and outlets 16-18 to the housing requires fluid to flow radially, axially, and then radially in order to be proportioned by the fluid valve. In some applications, the diameters O1 and O2 associated with the outlets may be critical to insure proper fluid delivery. As such, dimensions O1 and O2 can be design constraints within which the fluid valve must operate. The radial nature of the outlets combined with the axial fluid flow of the present invention allows the present invention to support larger outlets with relatively small valve packaging.

In more detail, the present invention sacrifices a slight pressure drop with the radial outlets 16-18 in exchange for smaller packaging. In more detail, the present invention is able to approximate the cross-section area of the outlets 16-18 with the gateway apertures 34-36 without requiring the gateway 30 to be at least twice the size of the outlets 16-18. In contrast, axial outlets require the gateway 30 to be at least twice the size of the outlets 16-18 in order to facilitate positioning the outlets 16-18 within the circumference of the gateway 30.

Figure 6:
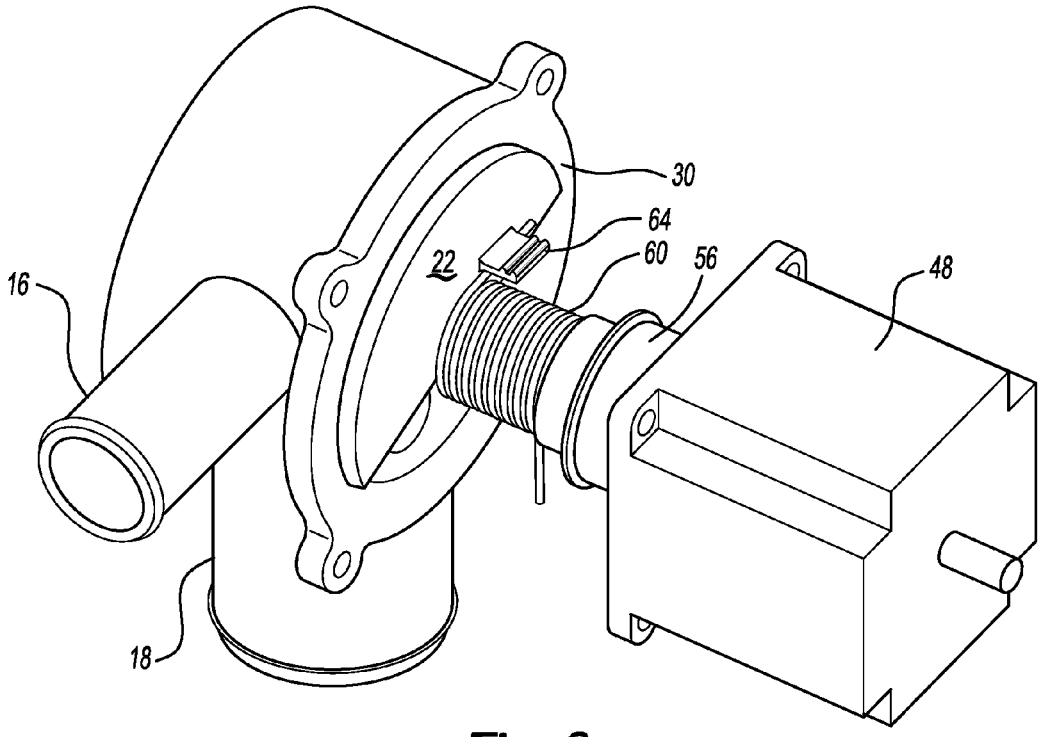
FIG. 6 illustrates a perspective assembly view of the fluid valve in accordance with one non-limiting aspect of the present invention.

FIG. 6 illustrates a perspective assembly view of the gateway 30, diverter 22, spring 60, seal 56, and electric motor 48 in accordance with one non-limiting aspect of the present invention. The compressive force of the fluid and spring 60 compress the diverter 22 against the gateway 30 to seal the outlets 16-18. Such axial sealing can be beneficial in limiting leakage of fluid through any covered outlet 16-18. Should the gateway 30 and/or diverter 22 wear over time, the compressive forces on the floating diverter cause it move axially with such wear to maintain the desired sealing.

Figure 7:
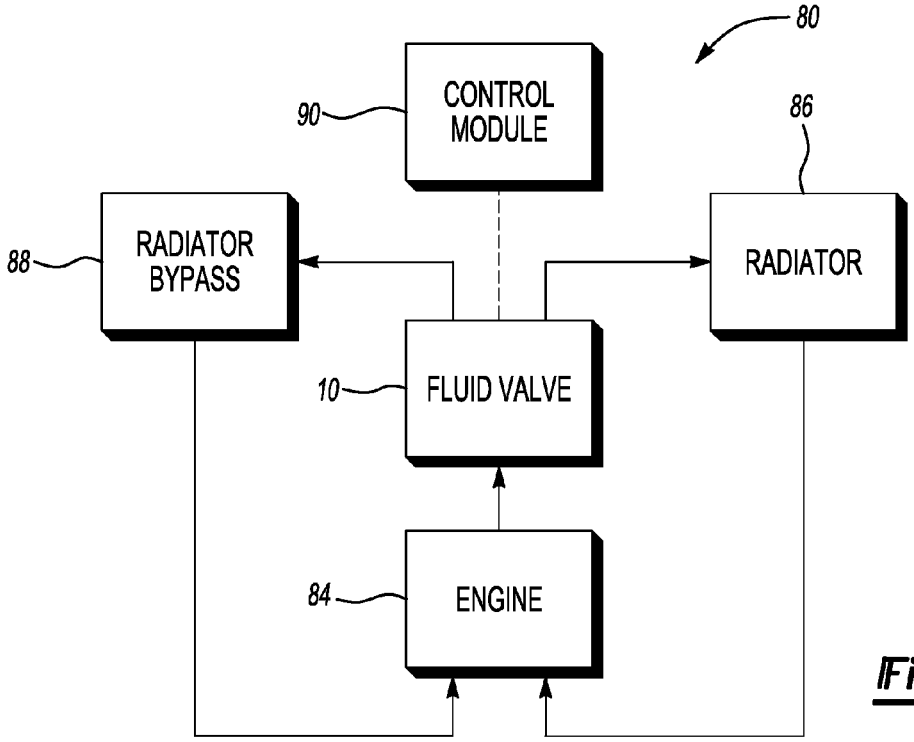
FIG. 7 illustrates a cooling system in accordance with one non-limiting aspect of the present invention.

FIG. 7 illustrates a cooling system 80 in accordance with one non-limiting aspect of the present invention. The cooling system 80 includes the above-described fluid valve 10 for controlling the flow of coolant used to cool an engine 84. The system 80 may include a radiator 86 configured to cool engine coolant and a radiator bypass 88 to direct coolant around the radiator 86 when cooling of the coolant is undesirable.

The fluid valve 10 is positioned downstream of the engine 84 and upstream of the radiator 86 and radiator bypass 88 within the coolant flow path. Ducting and/or other features generally illustrated with leader lines communicate the coolant from one location to another, as one having ordinary skill in the art will appreciate.

In operation, the fluid valve 10 receives coolant pressurized by the engine 84 and proportions it to one of the radiator 86 and radiator bypass 88. The pressure of the engine 84 is advantageous in causing the diverter 22 to float against the gateway 30, as described above. A vehicle control module 90 may be included to instruct operation of the fluid valve according to any number of cooling strategies.

The present invention fully contemplates other configurations and applications for the fluid valve 10 and/or cooling system 80. In particular, the present invention contemplates the fluid valve 10 including any number of inlets and outlets, with corresponding variations in the fluid valve 10 and diverter 22 to permit rotary proportioning between the various outlets.

With respect to the cooling system 80, for example, the fluid valve 10 may include an additional outlet (not shown) for a heater or other element. The additional outlet may operate in conjunction with diverter 22 positioning relative to the bypass outlet 18 and/or independently thereof so as to facilitate use of the coolant fluid for any number of vehicle operations. Such an additional outlet may include a radial configuration similar to the illustrated radial outlets 16-18 such that fluid flows through the additional outlet in a similar manner.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A cooling system for use with an engine, the system comprising:

a radiator;

a radiator bypass;

a fluid valve in communication with the engine, radiator, and radiator bypass, the fluid valve being controllable to proportion coolant from the engine to one or both of the radiator and radiator bypass in order to control engine cooling, the fluid valve including:

a housing having a hollow body portion configured to fluidly connect an inlet to first and second outlets, the first outlet providing coolant to the radiator bypass the second outlet providing coolant to the radiator, the body portion having a side portion extending between end portions, the inlet and outlets having connections extending away from an exterior of the side portion, the side portion being divided into non-overlapping first and second halves along a plane running parallel to the end portions with the first half having the inlet connection and the second half having both outlet connections; and a diverter separating the first half of the body from the second half and being controllable to proportion the fluid flow between the inlet and outlets.

2. The system of claim 1 wherein a length of the side portion is approximately equal to the sum of a diameter of the inlet connection plus a larger diameter of the first or second outlet connections.

3. The system of claim 2 further comprising a motor housed within a motor portion of the housing, the motor portion being adjacent to the body portion proximate one of the end portions and configured to control a position of the diverter.

4. The system of claim 1 wherein a cross-sectional area of the body portion along the plane is greater than the sum of both cross-sectional areas of the outlet connections, the cross-sectional areas of the outlet connections being determined according to an outer diameter of each connection.

5. The system of claim 4 wherein the diverter is shaped to cover less than all of the cross-sectional area of the body portion.

6. The system of claim 5 wherein the diverter is configured to rotate about a center point of the plane.

7. The system of claim 4 wherein the cross-sectional area of the body portion is not more than two times the sum of both cross-sectional areas of the outlet connections.

8. The system of claim 4 wherein the outer diameter of the outlets includes a rib to facilitate connecting to a hose.

9. The system of claim 1 wherein the second half of the body is partitioned into separate passages from the plane through to the outlet connections such that fluid flows separately within the second half of the body between the plane and the outlets.

10. The system of claim 9 wherein the diameter of the first outlet connection is less than the diameter of the second outlet connection.

11. The system of claim 10 wherein an area along the plane of each opening to each of the passages are equal to each other.

12. The system of claim 10 wherein an area of an opening to the passage leading to the first outlet is less than an area of an opening to the passage leading to the second outlet.

13. The system of claim 9 wherein the diverter is free-floating within the housing such that pressure of coolant entering the inlet causes the diverter to compress against the passages.

14. The system of claim 1 wherein the inlet is offset relative the outlets.

15. The system of claim 14 wherein a center of each outlet is aligned.

16. The system of claim 1 wherein the inlet is not coplanar with either one of the outlets.

17. The system of claim 16 wherein the outlets are coplanar.

18. The system of claim 1 further comprising a fail-safe feature configured to rotate the diverter to open the radiator aperture if power is lost to an electric motor used to position the diverter.

19. The system of claim 18 wherein the fail-safe feature is further configured to locate the diverter downstream of the inlet in the absence of coolant flow through the inlet.

20. The system of claim 1 further comprising an alignment feature configured to located the diverter downstream of the inlet in the absence of coolant flow through the inlet.

21. A fluid valve for proportioning a fluid flow comprising:

a housing having a hollow body portion configured to fluidly connect an inlet to first and second outlets, the body portion having a side portion extending between end portions, the inlet and outlets having connections extending away from an exterior of the side portion, the side portion being divided into non-overlapping first and second halves along a plane running parallel to the end portions with the first half having the inlet connection and the second half having both outlet connections; and a diverter separating the first half of the body from the second half and being controllable to proportion the fluid flow between the inlet and outlets.

22. The fluid valve of claim 21 wherein a length of the side portion is approximately equal to the sum of a diameter of the inlet connection plus a larger diameter of the first or second outlet connections.

23. The fluid valve of claim 21 further comprising a motor housed within a motor portion of the housing, the motor portion being adjacent to the body portion proximate one of the end portions and configured to control a position of the diverter.

24. The fluid valve of claim 21 wherein a cross-sectional area of the body portion along the plane is greater than the sum of both cross-sectional areas of the outlet connections, the cross-sectional areas of the outlet connections being determined according to an outer diameter of each connection.

25. The fluid valve of claim 24 wherein the diverter is shaped to cover less than all of the cross-sectional area of the body portion.

26. The fluid valve of claim 25 wherein the diverter is configured to rotate about a center point of the plane.

27. The fluid valve of claim 24 wherein the cross-sectional area of the body portion is not more than two times the sum of both cross-sectional areas of the outlet connections.

28. The fluid valve of claim 24 wherein the outer diameter of the outlets includes a rib to facilitate connecting to a hose.

29. The fluid valve of claim 21 wherein the second half of the body is partitioned into separate passages from the plane through to the outlet connections such that fluid flows separately within the second half of the body between the plane and the outlets.

30. The fluid valve of claim 29 wherein the diameter of the first outlet connection is less than the diameter of the second outlet connection.

31. The fluid valve of claim 30 wherein an area along the plane of each opening to each of the passages are equal to each other.

32. The fluid valve of claim 30 wherein an area of an opening to the passage leading to the first outlet is less than an area of an opening to the passage leading to the second outlet.

33. The fluid valve of claim 21 wherein the inlet is offset relative the outlets.

34. The fluid valve of claim 21 wherein a center of the outlets are aligned.

35. The fluid valve of claim 21 wherein the inlet is not coplanar with either one of the outlets.

36. The fluid valve of claim 21 wherein outlets are coplanar.

37. A fluid valve comprising:

a housing having a hollow body portion configured to fluidly connect an inlet to at least two outlets, the body portion having a side portion extending between end portions, the side portion being divided into non-overlapping first and second halves with the first half having the inlet and the second half having the outlets; and a diverter separating the first half of the body from the second half and being controllable with an electric motor to proportion fluid between the inlet and outlets.

38. The fluid valve of claim 37 wherein a cross-sectional area of the body portion along a plane running parallel to the end portions is greater than the sum of both cross-sectional areas of the outlets, the cross-sectional areas of the outlets being determined according to an outer diameter of each outlet.

39. The fluid valve of claim 38 wherein the cross-sectional area of the body portion along the plane is less than two times the sum of the cross-sectional areas of the outlets, the cross-sectional areas of the outlets being determined according to an outer diameter of each connection.

40. The fluid valve of claim 37 wherein the second half of the body is partitioned into separate passages from the plane through to each outlet such that fluid flows separately within the second half of the body between the plane and the outlets.

41. A fluid valve for proportioning a fluid flow comprising:

a housing having a hollow body portion configured to fluidly connect an inlet to first and second outlets, the body portion having a side portion extending between end portions, the inlet and outlets having connections extending away from an exterior of the side portion, the side portion being divided into non-overlapping first and second halves along a plane running parallel to the end portions with the first half having the inlet connection and the second half having both outlet connections;

a diverter separating the first half of the body from the second half and being controllable to proportion the fluid flow between the inlet and outlets;

wherein the second half of the body is partitioned into separate passages from the plane through to the outlet connections such that fluid flows separately within the second half of the body between the plane and the outlets; and wherein a cross-sectional area of the body portion along the plane is greater than the sum of both cross-sectional areas of the outlet connections, the cross-sectional areas of the outlet connections being determined according to an outer diameter of each connection.

* * * * *